United States Patent [19]

Proctor et al.

[11] Patent Number: 4,682,734

[45] Date of Patent: Jul. 28, 1987

[54] SPRAYING DEVICE HAVING CONTROLLED ADDITIVE FLUID FEED AND A TELESCOPING SPRAY TUBE ASSEMBLY

[75] Inventors: Rudy R. Proctor, Costa Mesa; Fred M. Reinstein, Encino, both of Calif.

[73] Assignee: Turbo Tek Enterprises, Inc., Los Angeles, Calif.

[21] Appl. No.: 713,824

[22] Filed: Mar. 20, 1985

[51] Int. Cl.[4] ..... B05B 7/26; B05B 9/04; A62C 31/02; E03B 7/07

[52] U.S. Cl. ..... 239/315; 239/316; 239/317; 239/323; 239/394; 137/564.5; 137/625.22; 285/302

[58] Field of Search ..... 137/205.5, 564.5, 625.22, 137/625.47; 239/203, 204, 310, 315, 316, 317, 323, 327, 394, 587; 285/302, 344, 360, 361, 376, 401, 402, 404

[56] References Cited

U.S. PATENT DOCUMENTS

| | | | |
|---|---|---|---|
| 263,415 | 8/1882 | Lightburne, Jr. | 285/361 X |
| 1,616,390 | 2/1927 | Powell | 285/337 X |
| 1,621,876 | 3/1927 | Doerr | 251/206 |
| 1,674,515 | 6/1928 | Johnson | 222/386.5 |
| 1,789,390 | 1/1931 | Potieiger | 137/625.16 X |
| 2,288,225 | 6/1942 | Boughton | 285/337 X |
| 2,436,680 | 2/1948 | Straussler | 137/625.22 X |
| 2,467,911 | 4/1949 | Reilly | 285/344 X |
| 2,473,139 | 6/1949 | Dickerman | 285/344 X |
| 2,494,598 | 1/1950 | Waring | 285/302 X |
| 2,618,510 | 11/1952 | Mills | 137/564.5 |
| 2,795,460 | 6/1957 | Bletcher et al. | 137/564.5 |
| 2,891,732 | 6/1959 | Orter et al. | 239/322 |
| 3,018,970 | 1/1962 | Wittenberg et al. | 239/323 |
| 3,151,737 | 10/1964 | Schmidt | 251/206 X |
| 3,166,096 | 1/1965 | Lang | 137/564.5 |
| 3,184,113 | 5/1965 | Curtis | 222/386.5 |
| 3,198,438 | 8/1965 | Hultgren | 239/318 |
| 3,377,028 | 4/1968 | Bruggeman | 239/394 |
| 3,447,753 | 6/1969 | Proctor et al. | 239/317 |
| 3,567,125 | 3/1971 | Houghton | 239/204 |
| 3,770,205 | 11/1973 | Proctor et al. | 239/317 |
| 3,776,463 | 12/1973 | Dyck | 239/204 |
| 3,938,218 | 2/1976 | DeAmicis | 285/302 X |
| 4,312,377 | 1/1982 | Knecht | 137/625.47 |
| 4,406,406 | 9/1983 | Knapp | 239/313 |
| 4,418,869 | 12/1983 | Healy | 239/317 |

FOREIGN PATENT DOCUMENTS

| | | | |
|---|---|---|---|
| 727492 | 4/1955 | United Kingdom | 239/313 |

*Primary Examiner*—Andres Kashnikov
*Assistant Examiner*—Patrick N. Burkhart
*Attorney, Agent, or Firm*—Fleit, Jacobson, Cohn & Price

[57] ABSTRACT

A spraying device (10) includes a compound fourway rotatable control valve (30), an additive fluid control disc member (84) and a spray selector disc member (104), whereby a primary fluid, such as water, and an additive fluid, such as detergent, can be sprayed or dispensed in various spray patterns separately, or as a mixture having selectively variable concentrations of the additive fluid in the primary fluid. The compound fourway rotatable valve 30 is movable from an inoperative "OFF" position into first, second and third "WATER RINSE", "SOAP-AND-WATER" and "SUDS ONLY" operative positions. The control disc member (84) includes a plurality of orifices (86) of various diameters for controlling the amount of additive fluid dispensed into the primary fluid from a resilient bladder (16) containing the additive fluid as the bladder is collapsed in response to external pressure thereon by the primary fluid. The spray selector disc member (104) provides various spray patterns as the result of having orifices (112) of various configurations formed therethrough and selectively positionable in alignment with a discharge orifice of the device. A telescoping spray tube assembly (122), which telescopes outwardly in response to fluid pressure, may be utilized in place of the spray selector disc member (104).

34 Claims, 7 Drawing Figures

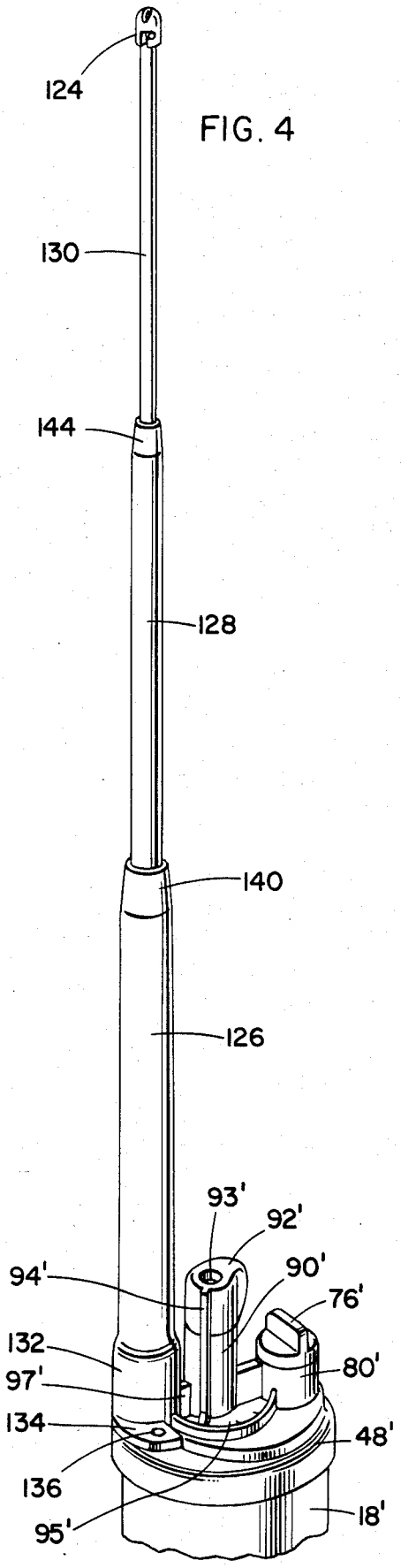
FIG. 4
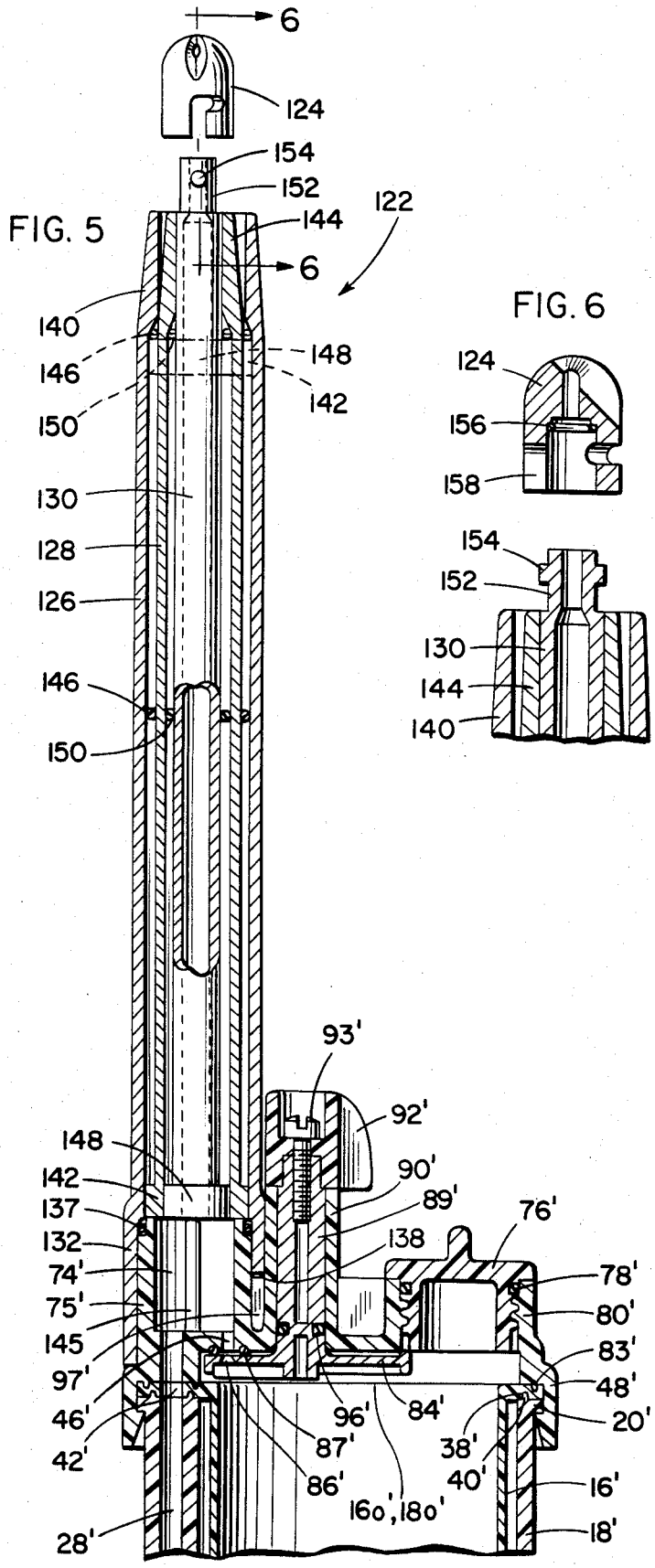
FIG. 5
FIG. 6

SPRAYING DEVICE HAVING CONTROLLED ADDITIVE FLUID FEED AND A TELESCOPING SPRAY TUBE ASSEMBLY

BACKGROUND OF THE INVENTION

1. Field of the Invention

This invention relates to a spraying device having controlled additive fluid feed, and more specifically to a spraying device having controlled additive fluid feed in which a primary fluid and an additive fluid can be sprayed in various spray patterns separately, or as a mixture having selectively variable concentrations of the additive fluid in the primary fluid.

2. Description of the Prior Art

Spraying devices are known in which an additive fluid, such as detergent, insecticide or fertilizer, are mixed with a primary fluid, such as water, as the primary fluid flows through a passageway or conduit in the spraying device. For example, the U.S. Pat. No. 3,447,753 to R. R. Proctor et al discloses a spray washer having a detergent feed in which a spraying device is in the form of a cap member which is attached to a jar-type reservoir for holding a detergent. The spraying device includes a rotatable control valve movable from an "OFF" position into a first operative position in which only water flows through the main passageway of the device. The valve also is rotatable into a position in which the valve diverts a portion of the water through an auxiliary passageway into the reservoir to agitate and stir the detergent therein and to force the detergent out of the reservoir into the water flowing through the main passageway of the spraying device to a discharge nozzle. A similar spraying device is disclosed in U.S. Pat. No. 3,770,205 to D. L. Proctor et al, in which a rotatable control valve has a third operative position in which the valve diverts a portion of the water through a second auxiliary passageway into the reservoir when pellets are being used in the reservoir.

The U.S. Pat. No. 2,795,460 to R. E. Bletcher et al, in FIGS. 7, 8 and 9, discloses a detergent dispensing device in which the detergent is stored in a resilient bag or bladder in a jar-type reservoir. Water flowing in a main passageway of the device then produces a vacuum on the interior of the resilient bag, and this vacuum, in combination with atmospheric pressure in the reservoir, causes the detergent in the bag to be dispensed into the water flowing in the main passageway to a brush head nozzle.

In another form of a device in which the additive fluid is stored in a resilient bladder in a reservoir, a portion of the primary fluid, such as water, is diverted into the reservoir to exert external pressure on the bladder to cause the bladder to dispense the additive fluid into the primary fluid flowing through a main passageway of the device. This type of device is disclosed in the U.S. Pat. No. 3,166,096 to H. Lang in which water flowing in a main pipe is diverted through an auxiliary line into an adjacent reservoir holding a resilient bladder which contains the additive fluid. When no additive fluid is desired to be added to the water flowing in the main pipe, a valve in the auxiliary line is closed.

The U.S. Pat. No. 4,418,869 to J. W. Healy also discloses a spraying device in which, when a control valve is moved to an operative position to permit water flow through the device, a portion of the water is diverted into a reservoir to apply pressure on a bladder containing the additive fluid. The additive fluid then is dispensed from the bladder through one of a plurality of different size apertures in a rotatable ring to vary the flow of the additive fluid into the water flowing through the device to a discharge nozzle. The rotatable ring can also be used to interrupt the dispensing of the additive fluid from the bladder.

In another known device of the bladder type, as disclosed in the U.S. Pat. No. 2,891,732 to R. H. Orter et al, a combination shower head and soap sprayer includes a switch for interrupting water flow in the shower head and directing the water against a piston in a soap reservoir. Movement of the piston in the soap reservoir then forces soap from the reservoir through a separate nozzle thereof.

Heretofore, prior known spraying or dispensing devices as discussed above, have been limited as to their flexibility of use for multiple purposes. In this connection, a need exists for a spraying device of the additive fluid feed type in which the primary fluid or the additive fluid can be sprayed or dispensed in various spray patterns, either separately or as a mixture having selectively variable concentrations of the additive fluid in the primary fluid. A need also exists for a spraying device in which a spray nozzle can be automatically positioned closely adjacent an article being sprayed without having to position the spraying device, per se, closely adjacent the article, and in which the nozzle can readily be retracted to an inoperative position when the spraying operation is completed. Accordingly, a purpose of this invention is to provide such a spraying device which is of simple, rugged construction and inexpensive to manufacture.

SUMMARY OF THE INVENTION

In general, a spraying device having a controlled additive fluid feed in accordance with the invention comprises a connecting means adjacent an entrance orifice of the device for connecting a conduit means of the device to a source of a primary fluid. A control means is disposed in the conduit means for selectively diverting at least a portion of the primary fluid at an upstream portion of the conduit means such that the primary fluid exerts external pressure on a collapsible chamber means to cause the chamber means to collapse and dispense additive fluid therein into a downstream portion of the conduit means. The control means is selectively movable from an inoperative "OFF" position into a first operative position in which the control means permits only the primary fluid to flow through the conduit means, and into a second operative position in which the control means diverts a portion of the primary fluid such that the primary fluid exerts external pressure on the chamber means while permitting the primary fluid to continue to flow through the conduit means.

The control means also may be movable into a third operative position in which the control means directs the primary fluid to exert external pressure on the chamber means to dispense the additive fluid into the downstream portion of the conduit means for discharge from the device, while precluding the flow of the primary fluid through the conduit means for discharge from the device. A second control means also may be provided for controlling the amount of the additive fluid dispensed from the collapsible chamber means. In addition, spray selector means may be movably mounted adjacent a discharge orifice of the device and may have a plurality of orifices of different configurations formed therethrough, with the spray selector means being movable to position respective ones of the orifices in alignment with the discharge orifice of the device to vary the configuration of a fluid stream emanating from the discharge orifice. Further, movement of the first-mentioned control means to its "OFF" position may cause release of pressure on the chamber means by the primary fluid.

More specifically, a spraying device having a controlled additive fluid feed may comprise a housing which is open at one end and which has a primary fluid entrance orifice and a portion of a fluid conduit means formed therein. A resilient bladder having an open end is positioned in the open end of the housing for holding a supply of an additive fluid, and the housing has an orifice therein spaced from the open ends of the housing and the bladder and through which the primary fluid can flow to exert external pressure on the bladder. A cap member is mounted on the open end of the housing in covering relationship to the open end of the bladder, and the cap member also has a portion of a fluid conduit means formed therein in alignment with the portion of the conduit means in the housing. In addition, the cap member has an orifice therein through which the additive fluid can flow from the open end of the bladder into the conduit means. First control means is mounted in the housing adjacent the fluid entrance orifice for selectively diverting at least a portion of the primary fluid into the orifice in the housing such that the primary fluid exerts external pressure on the bladder to cause the bladder to collapse and to dispense the additive fluid from the open end of the bladder through the orifice in the cap member and into the conduit means. The first control means, when in an "OFF" position, also permits the primary fluid which has been diverted to exert external pressure on the bladder, to drain from the housing and thus release the pressure on the bladder. In addition, a second control means is mounted on the cap member for varying the amount of the additive fluid dispensed from the open end of the bladder into the conduit means. An elongated tube extends from the conduit means in the cap member and has an outer end adjacent a discharge orifice of the device, and a spray selector means is movably mounted adjacent the discharge orifice of the device and the outer end of the elongated tube for varying the configuration of a fluid stream emanating from the discharge orifice. The first control means may be a compound rotatable four way control valve, the second control means may be in the form of a rotatably mounted disc member having a plurality of orifices of different sizes formed therethrough, and the spray selector means may be a rotatably mounted disc member having a plurality of orifices of different sizes and/or configurations formed therethrough.

The spraying device may further include a telescoping spray tube means of special construction having a discharge orifice through which fluid is sprayed from the device. The telescoping spray tube means extends outwardly automatically in response to the pressure of fluid flow therethrough. The telescoping spray tube means also is constructed to readily accommodate interchangeable spray nozzles of different configurations for varying the configuration of a fluid stream emanating from the spray tube means.

BRIEF DESCRIPTION OF THE DRAWINGS

FIG. 4 is an isometric view of a telescoping spray tube assembly which may be utilized in a modified form of the spraying device of FIGS. 1-3, showing the spray tube assembly in an extended operating condition;

FIG. 5 is an enlarged cross-sectional view of the telescoping spray tube assembly shown in FIG. 4 in a retracted inoperative condition; and FIG. 6 is an enlarged cross-sectional view taken along the line 6—6 in FIG. 5.

DETAILED DESCRIPTION

Figure 1A:
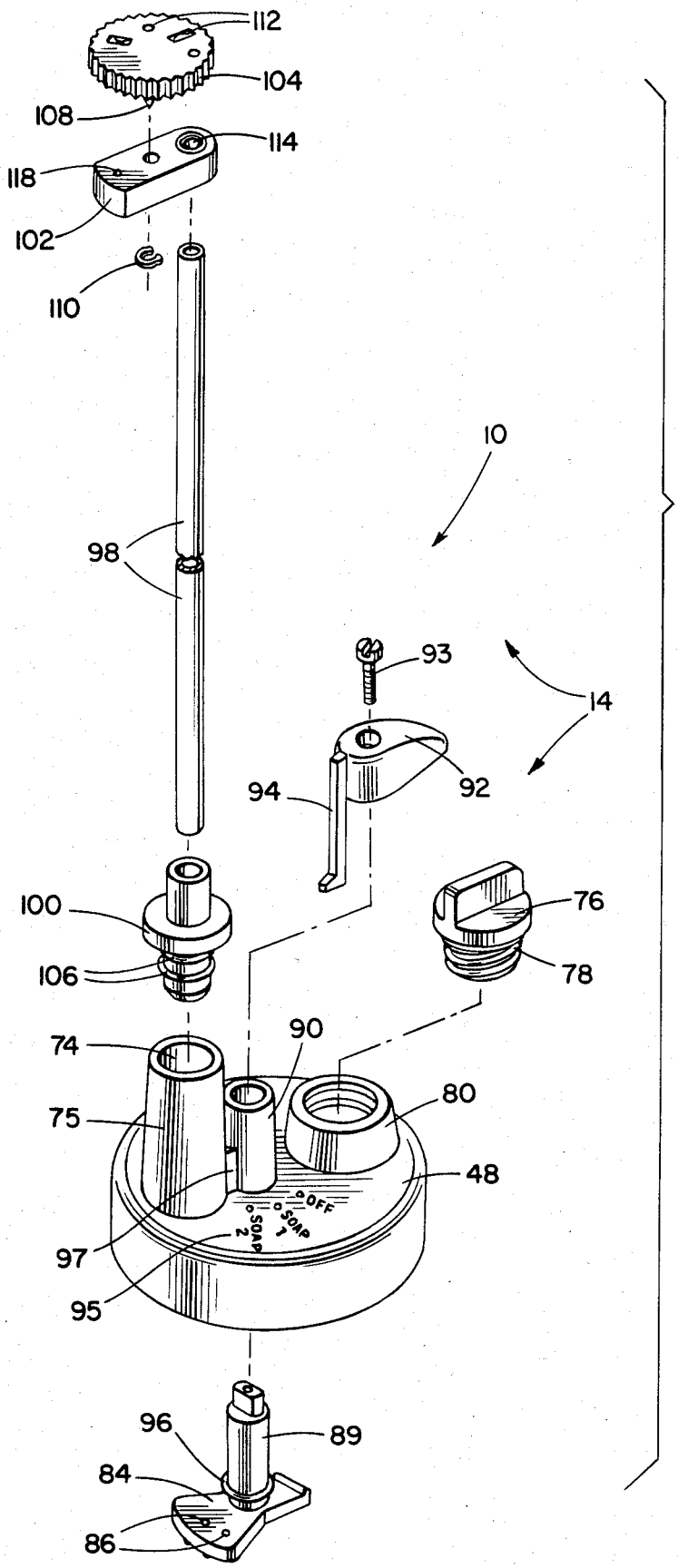
FIGS. 1A and 1B are exploded isometric views of a spraying device in accordance with the invention.
Figure 1B:
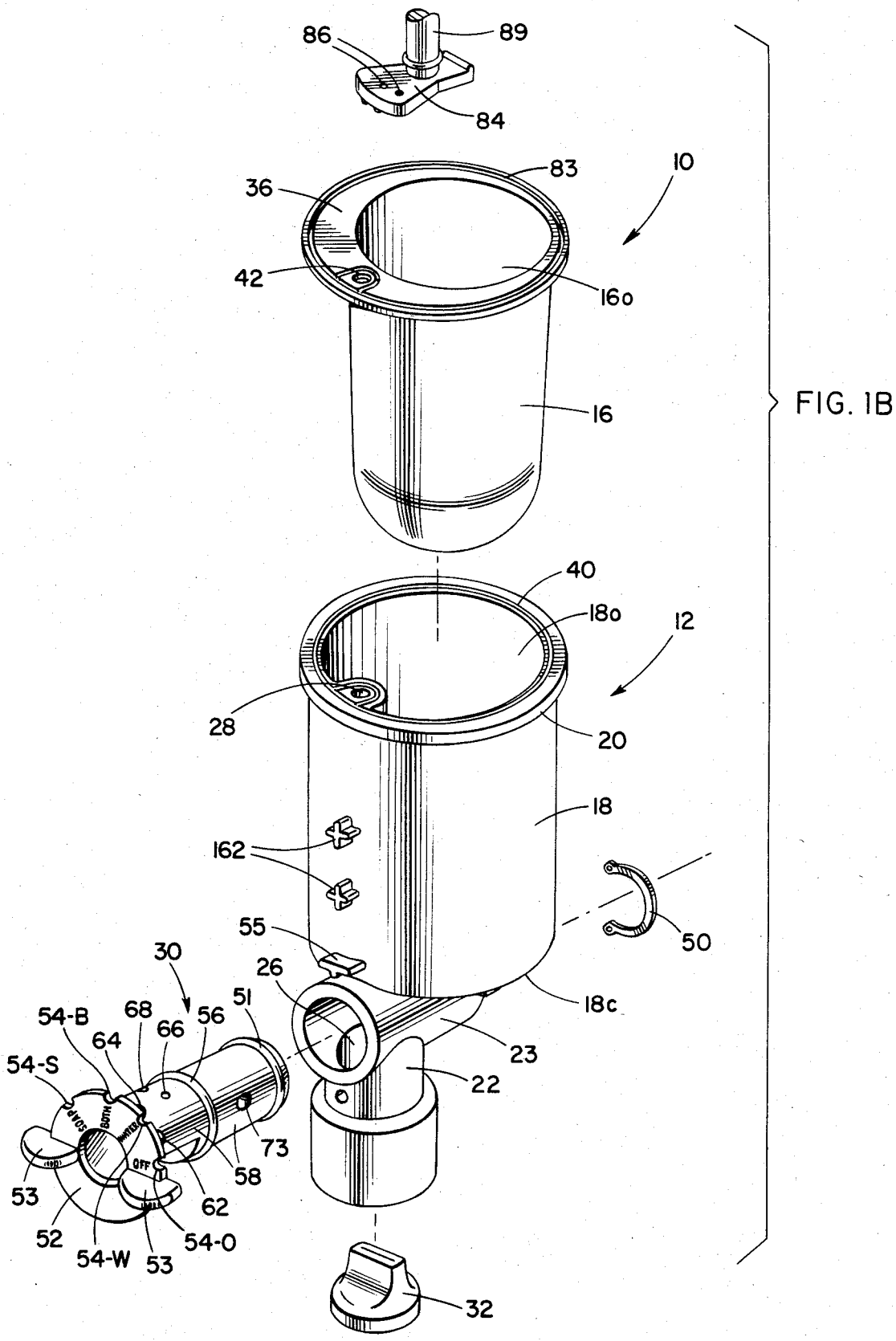
Figure 2:
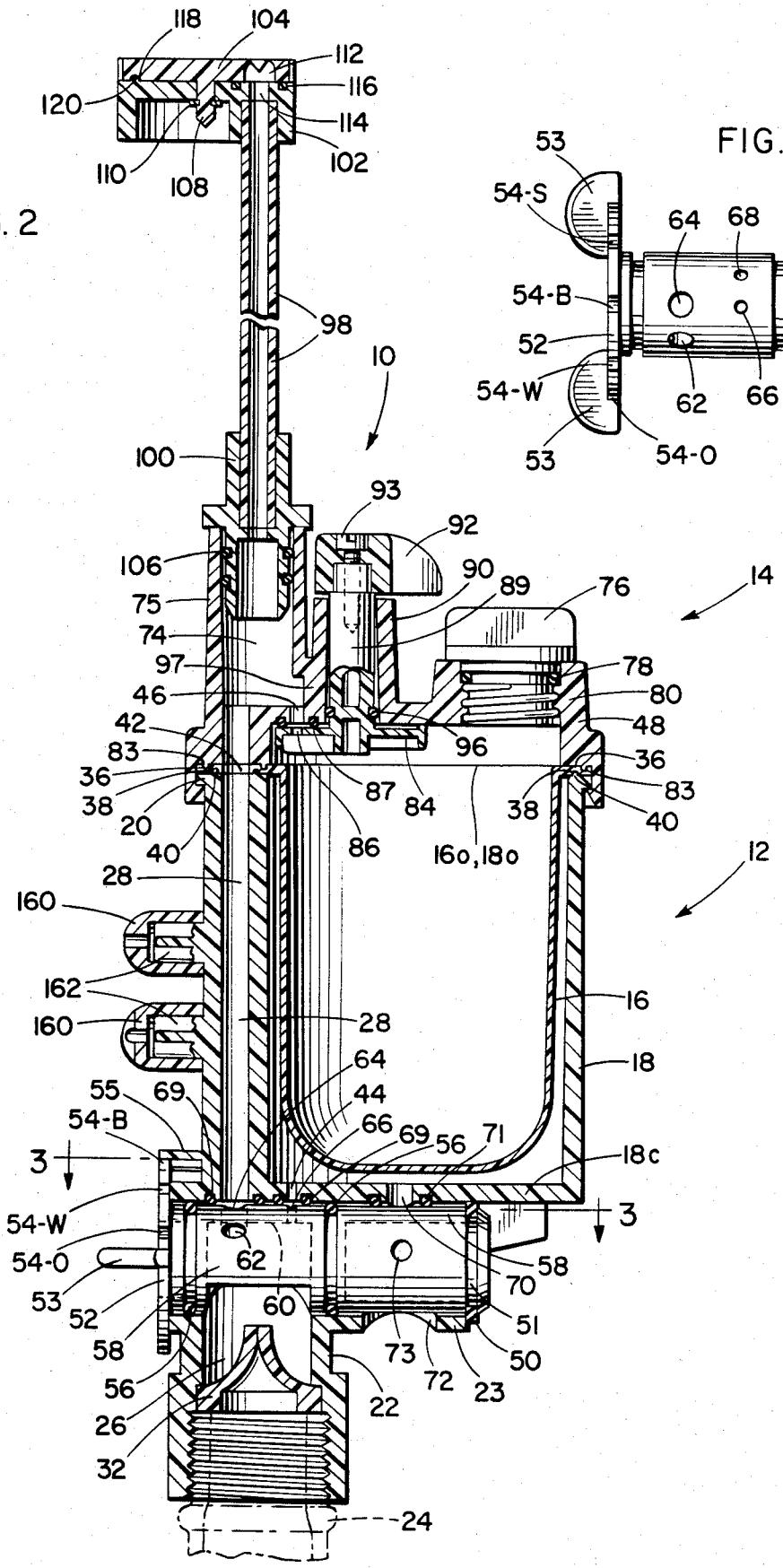
FIG. 2 is a cross-sectional assembly view of the spraying device shown in FIGS. 1A and 1B.

Referring to FIGS. 1A, 1B and 2, in the illustrated embodiment of the invention a spraying device 10 is shown in the form of a spray washer comprising a body or housing subassembly 12 (FIGS. 1B and 2) and a cap subassembly 14 (FIGS. 1A and 2) through which a primary fluid, such as water, can flow during a spraying operation. The spraying device 10 further includes a resilient collapsible cylindrical rubber bladder 16 (FIGS. 1B and 2) which defines a chamber for an additive fluid, such as soap or detergent, and from which the additive fluid can be dispensed during a spraying operation by exerting external pressure on the bladder.

The housing subassembly 12 (FIGS. 1B and 2) includes a plastic (e.g., polyethylene) housing 18 of generally cylindrical construction which has an open end **18*o* and an essentially closed end 18*c*. A circumferentially extending support flange 20 is provided around the open end 18*o* of the housing 18. A projecting connecting portion 22 extends from a cylindrical valvemounting portion 23 adjacent the essentially closed end 18*c* of the housing 18 and is internally threaded for connecting the housing to a water source, such as a garden hose or pipe 24, illustrated in dashed lines adjacent the bottom of FIG. 2**.

The connecting portion 22 and the valve-mounting portion 23 of the housing 18 include an internal passageway or conduit portion 26 (best shown in FIG. 2) which defines an entrance portion of a conduit for the flow of water through the housing. The connecting portion 22 communicates with an elongated tubular passageway or conduit 28 having walls formed integrally with an interior wall of the housing 18 and extending the length (vertically in FIGS. 1 and 2) of the housing. Water flows from the entrance passageway 26 into the tubular passageway 28 is controlled by a compound four-way rotatable plastic valve 30. Reverse flow of water in the entrance passageway 26 is precluded by a one-way plastic check valve 32 of a suitable type.

The collapsible resilient bladder 16 is positionable in the open end **18*o* of the housing 18 into the interior of the housing as shown in FIG. 2. The bladder 16 includes an open end 16*o* and a circumferentially extending support flange 36 of eccentric construction, as is best shown in FIG. 1B. The flange 36 mates with the circumferentially extending support flange 20 of the housing 18 and includes a circumferentially extending groove 38 (FIG. 2) which receives a corresponding sealing ring 40 of the flange 20. An eccentric portion of the flange 36 includes an aperture 42 formed in the flange so as to be in alignment with the housing tubular passageway 28**.

The essentially closed end wall 18*c* of the housing 18 is provided with an orifice 44 which interconnects the entrance passageway 26 of the housing connecting portion 22 and valve-mounting portion 23 with the interior of the housing so that water can be selectively introduced into the housing to exert external pressure on the bladder 16 within the housing, so as to cause the bladder to collapse and thereby dispense the soap or detergent therein through an orifice 46 formed in a wall of a plastic cap member 48 of the cap subassembly 14. As in the flow of water from the entrance passageway 26 into the tubular passageway 28, flow of water from the entrance passageway 26 through the orifice 44 into the interior of the housing 18 is controlled by the compound rotatable control valve 30.

The compound rotatable control valve 30 is disposed transversely across the entrance passageway 26 of the housing connecting portion 22 and valve-mounting portion 23 and is rotatably mounted in the valve-mounting portion. The rotatable control valve 30 is maintained in position in the valve-mounting portion 23 by a C-shaped spring clip 50 disposed in a circumferentially extending groove 51 formed in the rotatable valve at the right-hand side thereof as viewed in FIGS. 1B and 2. An indicator disc 52, having gripping ears 53, is integrally formed on the left hand side of the rotatable control valve 30, as viewed in FIGS. 1B and 2, and includes peripheral indicating grooves 54-O, 54-W, 54-B and 54-S for selectively receiving a locating rib on a lower side of a projecting resilient retaining post 55 integrally formed on the housing 18, as is best shown in FIG. 1B. The rotatable control valve 30 also carries suitable O-ring seals 56 for precluding flow of water out of the entrance passageway 26 around the opposite ends of the valve.

More specifically, the compound rotatable control valve 30 includes a body portion 58 having a cylindrical outer surface, but with a part of the body portion cut away to expose an interior cylindrical surface 60 facing generally toward the direction from which water flows into the entrance passageway 26. Four valve ports 62, 64, 66 and 68 are formed diametrically through the body portion 58 of the control valve 30 so that one end of each port opens through the cylindrical outer surface of the body portion and an opposite end of each port opens through the interior cylindrical surface 60 of the body portion. As viewed in FIG. 1B, the port 62 extends through the body portion 58 at an angle to the vertical in a first direction (downward to the left in FIG. 1B), the ports 64 and 66, which are spaced axially along the axis of rotation of the valve, extend vertically and the port 68 extends at an angle to the vertical in an opposite direction (downward to the right in FIG. 1B). The ports 62 and 64, which can be selectively aligned with the housing tubular passageway 28 for controlling the flow of water into the tubular passageway, are relatively large in diameter in comparison to the ports 66 and 68, which can be selectively aligned with the orifice 44 in the end wall 18*c* of the housing 18 for controlling the flow of water through the orifice into the interior of the housing. O-ring seals 69 are disposed in corresponding grooves in the wall 18*c* of the housing around entrances to the tubular passageway 28 and the orifice 44, respectively.

As is best shown in FIG. 2, the essentially closed end wall 18*c* of the housing 18 also includes a drain hole 70 surrounded by an O-ring seal 71, and the cylindrical valve-mounting portion 23 of the housing 18 includes a drain hole 72, for draining water from the interior of the housing and relieving pressure on the bladder 16. For this purpose, the rotatable control valve 30 includes a drain port 73 extending diametrically therethrough and alignable with the drain holes 70 and 72 when the valve is in an inoperable "OFF" position.

In operation of the rotatable control valve 30, rotation of the valve counterclockwise as viewed in FIG. 1B, so that the locating rib on the retaining post 55 is received in the right-hand groove 54-O of the indicator disc 52, moves the valve into its inoperative "OFF" position. In this "OFF" position, neither of the ports 62 or 64 is aligned with the housing tubular passageway 28, neither of the ports 66 or 68 is aligned with the housing orifice 44, and the drain port 73 is aligned with the housing drain holes 70 and 72. When the control valve 30 then is rotated clockwise, as shown in FIG. 1B, so that the locating rib of the retaining post 55 is received in the indicator disc groove 54-W, the valve is moved into a first operative position in which the port 62 is aligned with the tubular passageway 28 for a "WATER RINSE" operation. By then rotating the control valve 30 an additional step clockwise as viewed in FIG. 1B, such that the locating rib of the retaining post 55 is received in the indicator disc groove 54-B, the control valve assumes a second operative position in which the ports 64 and 66 are aligned with the housing tubular passageway 28 and the housing orifice 44, respectively, for a "SOAP AND WATER" dispensing operation, in which soap in the bladder 16 is dispensed and added to water downstream in the cap member 48 of the cap member subassembly 14, such that mixed soap and water both flow from the spraying device 10. Rotation of the control valve 30 clockwise an additional step in FIG. 1B, to position the locating rib of the retaining post 55 in the disc indicator groove 54-S, then brings the control valve into a third operative condition in which the port 68 is aligned with the housing orifice 44 for a "SOAP ONLY" operation, in which soap is dispensed from the bladder 16 for discharge from the spraying device 10, while the central body portion 58 of the control valve 30 precludes flow of water into the housing tubular passageway 28 and thus precludes discharge of water from the spraying device.

The soap is dispensed from the bladder 16 through the orifice 46 in the cap member 48 into an internal passageway or conduit portion 74 which is formed in a projecting pedestal 75 of the cap member and which is aligned with the tubular passageway 28 in the housing 18. A removable plug 76, which includes an O-ring seal 78, is screw threaded into an opening which is formed in a pedestal portion 80 of the cap member 48, and through which the bladder can be replenished with soap from a dispenser bottle (not shown) as necessary. The cap member 48 is of a snap-on type so as to be removably mounted on the open end 18*o* of the housing 18 in covering relationship to the open end 16*o* of the bladder 16, with an annular groove 83 of bladder support flange 36 receiving a corresponding annular sealing ring on the cap member, as shown in FIG. 2.

The cap subassembly 14 includes a rotatably mounted plastic partial disc member 84 for selectively varying the amount of soap which is dispensed from the bladder 16 through the orifice 46 in the cap member 48. For this purpose, the disc member 84 has a plurality of orifices 86 of different diameters formed therethrough, and the disc member is rotatably mounted to position a selected one of the orifices in alignment with the orifice 46 in the cap member 48. Flow of soap through the orifice 46 other than by way of one of the orifices 86 in the disc member 84 is precluded by a suitable O-ring seal 87 (FIG. 2). Further, when none of the orifices 86 in the disc member 84 are in alignment with the orifice 46, the disc member can be utilized to supplement the rotatable control valve 30 in precluding flow of soap from the bladder 16.

The disc member 84 is integrally formed on an inner end of a support shaft 89 rotatably mounted in a projecting pedestal 90 of the cap member 48. An outer end of the support shaft 89 is secured to an operating lever 92 by a screw 93. As is shown in FIG. 1A, the operating lever 92 includes a depending indicating finger 94 cooperable with suitable indicia 95 on the top of the cap member 48. A suitable O-ring seal 96 surrounds the support shaft 89 within the projecting pedestal 90, as shown in FIG. 2. The pedestal 90 is integrally joined to the cap member pedestal 75 by a reinforcing web 97.

A fluid conduit portion in the form of an elongated plastic tube 98, which forms an extension of the internal passageway 74 in the cap member pedestal 75, has an inner end force-fitted into a tube holder 100, and has an outer end force fitted into a plastic support member 102 for a plastic spray selector disc member 104. The tube holder 100 includes an inner mounting portion having a slight inward taper (e.g., 1°) which is force-fitted or otherwise suitably mounted into the internal passageway 74 of the cap member pedestal 75, and which carries a pair of suitable O-ring seals 106.

The spray selector disc member 104 is removably and rotatably mounted on the support member 102 by a central shaft 108 of the disc member extending through an aperture in the support member, with a suitable C-shaped spring clip 110 disposed in an associated circumferentially extending groove in the central shaft. The disc member 104 has a plurality of orifices 112 of different configurations formed therethrough which can be selectively aligned with a discharge opening 114 in the support member 102 and the outer end of the elongated tube 98, to provide different spray patterns for a fluid stream emanating from the discharge opening. For example, the disclosed spray selector disc member 104 includes orifices 112 in the form of a small diameter hole (FIG. 1A) for producing a fine spray, a larger diameter hole (FIG. 1A) for producing a coarse spray, an elongated slot (FIGS. 1A and 2) having interior spherically-shaped walls for producing a coarse fan spray, and a similarly shaped shorter slot (FIG. 1A) for producing a fine fan spray. The disc member 104 also can be removed from the support member 102 and replaced with other spray selector disc members (not shown) having spray-defining orifices of other configurations, as desired. An O-ring seal 116 (FIG. 2), disposed in a corresponding groove of the support member 102, surrounds the discharge opening 114 in the support member. In addition, a raised protruberance 118 is provided on the support member 102 for mating with suitably located indentations 120 (one shown in FIG. 2) in an opposed surface of the spray selector disc member 104 for locking the disc member in each of its operative positions.

Figure 3:
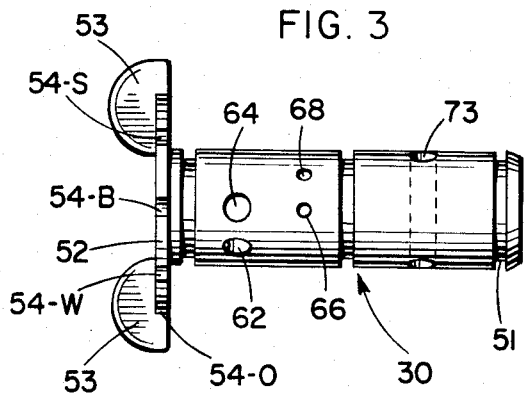
FIG. 3 is a view of a compound four-way control valve in accordance with the invention as seen along the line 3—3 in FIG. 2.

FIGS. 4, 5 and 6 disclose a telescoping spray tube assembly 122 which may be utilized in place of the assembly comprising the one-piece tube 98, tube holder 100, spray selector disc support member 102 and the spray selector disc 104, in the spraying device 10 shown in FIGS. 1, 2 and 3, to provide a modified spraying device 10'. The spray tube assembly 122 is constructed such that the assembly automatically extends to an elongated operative position, as shown in FIG. 4, in response to pressure caused by the flow of a fluid through the tube assembly, so as to position a nozzle 124, which defines a discharge orifice of the tube assembly, closely adjacent an article (not shown) being sprayed. When a spraying operation has been completed, the spray tube assembly 122 may be manually collapsed to a retracted inoperative condition as shown in FIG. 5.

The telescoping spray tube assembly 122 comprises an outer plastic tube 126, an intermediate plastic tube 128, and an inner plastic tube 130 having the discharge nozzle 124 removably mounted on an outer end thereof. An inner end portion 132 of the outer tube 126 has an internal diameter such that the inner end portion can be mounted over a projecting pedestal 75' of a cap member 48' of the spraying device 10', as shown in FIGS. 4 and 5. For this purpose, a lower end of the outer tube 126 includes apertured laterally projecting ears 134 (FIG. 4) which receive respective upstanding locating posts 136 formed on the cap member 48' on opposite sides of the pedestal 75' and having their upper ends flattened into the form of rivets to retain the telescoping spray tube assembly 122 on the cap member 48'. An O-ring seal 137 for the outer tube 126 is provided on an annular shoulder at an upper end of the pedestal 75'.

The outer tube 126 also includes a slot 138 (FIG. 5) which straddles a reinforcing web 97' between the pedestal 75' and a cap member pedestal 90'. Further, an outer end portion 140 of the outer tube 126 is of reduced diameter to limit outward telescoping movement of the intermediate tube 128 therein when the spray tube assembly 122 is in its extended position.

Referring to FIG. 5, an inner end of the intermediate tube 128 includes an annular flange 142 receivable in the outer tube 126 in closely spaced relationship. As in the case of the outer tube 126, an outer end portion 144 of the intermediate tube 128 is of reduced diameter to limit outward telescoping movement of the inner tube 130 therein when the spray tube assembly 122 is in its extended position. Further, the cap member pedestal 75' includes a vertical inwardly-directed stop rib 145 for precluding the inner tube 130 from dropping into the interior of the pedestal.

An O-ring seal 146 (FIG. 5) of circular cross-section surrounds the intermediate tube 128 and is disposed between opposed surfaces of the intermediate tube and the outer tube 126. When the spray tube assembly 122 is in its retracted collapsed condition as shown in FIG. 5, the O-ring seal 146 normally is located approximately halfway between the intermediate tube flange 142 and the reduced end portion 140 of the outer tube 126, as shown in that figure.

As in the case of the intermediate tube 128, an inner end of the inner tube 130 also includes an annular flange 148 which is receivable in the intermediate tube 128 in closely spaced relationship. An O-ring seal 150 of circular cross-section, comparable to the O-ring seal 146, surrounds the inner tube 130 approximately halfway between the flange 148 and the reduced outer end portion 144 of the intermediate tube 128, when the spray tube assembly 122 is in its retracted collapsed condition as shown in FIG. 5.

As is best shown in FIG. 6, an outer end portion 152 of the inner tube 130 includes a pair of oppositely extending retaining lugs 154 which form parts of a quick-releaseable connection for removably mounting the discharge nozzle 124 on the inner tube. In this regard, the nozzle 124 is formed with an inner socket in which the outer end portion 152 of the inner tube 130 can be received in seating relationship against an O-ring seal 156.

Referring to FIGS. 5 and 6, opposite walls of the discharge nozzle 124 which define the socket therein also include respective ones of a pair of essentially right-angle slots 158 for receiving respective ones of the retaining lugs 154. In use, the nozzle 124 initially is positioned on the outer end portion 152 of the inner tube 130 with the retaining lugs 154 received in axially extending portions of the right-angle slots 158, and then the nozzle is rotated slightly to dispose the lugs in seat portions at inner ends of circumferentially extending portions of the right-angle slots, thereby releasably locking the nozzle on the inner tube. Thus, the nozzle 124 and other nozzles 160, illustrated at the left-hand left-hand side of FIG. 2, of different configurations and having right-angle mounting slots identical to the slots 158, readily can be interchangeably mounted on the inner tube 130 to provide various spray patterns, depending upon the manner in which the spraying device 10' is being utilized, as desired. For this purpose, referring to FIGS. 1B and 2, the housing 18 may include projecting mounting lugs 162 for storing the nozzle 124 and/or the other interchangeable nozzles 160 on the spraying device 10'.

In use, when the control valve 30 shown in FIGS. 1–3 is operated to its "WATER RINSE" or "SOAP AND WATER" positions to cause water or a soap-water mixture, respectively, to flow through the spraying device 10' into the telescoping spray tube assembly 122, fluid pressure on the intermediate tube annular flange 142 and the inner tube annular flange 148 automatically causes the intermediate tube 128 to telescope outwardly in the outer tube 126, and the inner tube 130 to telescope outwardly in the intermediate tube, respectively. Thus, the nozzle 124 on the inner tube 130 can be automatically moved closely adjacent an article (not shown) for a spraying operation in response to actuation of the spraying device 10'. (The same extension of the tube assembly 122 tends to occur, although to a lesser extent, when the control valve is moved into its "SOAP ONLY" operative position.) When the spraying operation is completed and the spraying device 10' is turned off, the tube assembly 122 can be collapsed manually back to its retracted condition as shown in FIG. 5, as noted above.

When the intermediate tube 128 and the inner tube 130 advance in a telescoping operation, the O-ring seals 146 and 150 tend to roll forward with the tubes on the opposed surfaces of the tubes to facilitate their advancement. As is illustrated by broken lines in FIG. 5, ultimately the O-ring seals 146 and 150 roll and seat against the reduced diameter outer end portions 140 and 144 of the outer tube 126 and the intermediate tube 128, respectively, with the intermediate tube annular end flange 142 and the inner tube annular end flange 148 seating against their respective O-ring seals to limit outward movement of the tubes. Similarly, when the spray tube assembly 122 is collapsed back to its retracted condition as described above, the O-ring seals 146 and 150 roll back to their intermediate positions as shown in solid lines in FIG. 5, to facilitate retraction of the tube members 126, 128 and 130.

In summary, a new and improved spraying device 10 has been provided in which a primary fluid, such as water, and an additive fluid, such as soap, can be sprayed or dispensed in various spray patterns separately, or as a mixture having selectively variable concentrations of the additive fluid in the primary fluid. Control for this purpose is provided in part by the compound four-way control valve 30 which is movable from an inoperative "OFF" position into first, second and third "WATER RINSE", "SOAP-AND WATER", and "SOAP ONLY" operative positions. Additional control over the concentration of the additive fluid in the primary fluid is provided by the rotatable disc member 84 of the cap subassembly 14 and the plurality of orifices 86 of different diameters in the disc member. In addition, various spray patterns for different uses are provided by the rotatable spray selector disc member 104 having the orifices 112 of various configurations formed therethrough and selectively positionable in alignment with the discharge opening 114 in the associated support member 102. The construction of the spraying device 10 also is such that, with minor changes in the construction of the cap member pedestal 75, the telescoping spray tube assembly 122 can be used to provide a modified spraying device 10' if so desired.

What is claimed is:

1. A spraying device having controlled additive fluid feed, which comprises:

conduit means for conveying fluid between an entrance orifice and a discharge orifice of the device;

connecting means adjacent the entrance orifice of the device for connecting the conduit means to a source of a primary fluid;

collapsible chamber means for holding a supply of an additive fluid, the chamber means being in communication with the conduit means and being collapsible in response to external pressure to dispense the additive fluid into the conduit means; and a rotatable control valve disposed in the conduit means for selectively diverting at least a portion of the primary fluid at an upstream portion of the conduit means such that the primary fluid exerts external pressure on the chamber means to cause the chamber means to collapse and dispense the additive fluid into a downstream portion of the conduit means;

the rotatable control valve being movable from an inoperative position in which no fluid flows through the conduit means, into a first operative position in which the control valve permits only the primary fluid to flow through the conduit means, into a second operative position in which the control valve diverts a portion of the primary fluid such that the diverted primary fluid exerts external pressure on the chamber means to cause the additive fluid in the chamber means to be dispense into the primary fluid flowing through the conduit means, and into a third operative position in which the control valve directs the primary fluid such that the primary fluid exerts external pressure on the chamber means to dispense the additive fluid into the downstream portion of the conduit means for discharge of only additive fluid from the device through the discharge orifice, while precluding flow of the primary fluid through the conduit means for discharge from the device through the discharge orifice; and the rotatable control valve having a first port which is operative when the valve is in the first operative position, second and third ports which are operative when the valve is in the second operative position, and a fourth port which is operative when the valve is in the third operative position.

2. The spraying device as recited in claim 1, which further comprises:

control means adjacent the collapsible chamber means for varying the amount of additive fluid dispensed from the chamber means into the conduit means.

3. The spraying device as recited in claim 2, in which:

the control means is a rotatably mounted disc member having a plurality of orifices of various sizes formed therethrough.

4. The spraying device as recited in claim 1, which further comprises:

spray selector means movably mounted adjacent the discharge orifice of the device and having a plurality of orifices of different configurations formed therethrough, the spray selector means being movable to position respective ones of the orifices therein in alignment with the discharge orifice of the device to vary the configuration of a fluid stream emanating from the discharge orifice.

5. The spraying device as recited in claim 4, in which:

the spray selector means is a rotatably mounted disc member.

6. The spraying device as recited in claim 1, which further comprises:

telescoping spray tube means forming part of the conduit means and including the discharge orifice of the spraying device, for spraying fluid from the device.

7. The spraying device as recited in claim 6, in which:

the telescoping spray tube means includes means for automatically extending a portion of the spray tube means outwardly in response to pressure produced by fluid flowing through the spray tube means.

8. The spraying device as recited in claim 7, in which:

the telescoping spray tube means includes an outer tube and at least one additional inner tube reciprocably disposed in the outer tube and extendable outwardly relative to the outer tube;

the automatic extending means includes an annular flange on an inner end of the inner tube responsive to fluid pressure to cause the inner tube to move in the outer tube outwardly relative to the outer tube; and the outer tube includes movement limiting means at an outer end thereof cooperable with the annular flange to limit outward movement of the flange and the inner tube in the outer tube.

9. The spraying device as recited in claim 8, in which:

a cap member includes a projecting pedestal which defines at least part of the portion of the conduit means formed in the cap member;

an inner portion of the outer tube of the telescoping spray tube means is mounted on the pedestal and includes laterally projecting apertured ears adjacent an inner end thereof; and the cap member includes projecting mounting posts on opposite sides of the pedestal and disposed in the lateraly projecting ears of the outer tube.

10. The spraying device as recited in claim 9, in which:

the projecting pedestal on the cap member includes an internal stop means for precluding movement of the inner tube into the pedestal.

11. The spraying device as recited in claim 1, in which:

the rotatable valve also is selectively movable into an inoperative "OFF" position and includes a fifth port for draining the primary fluid and releasing pressure on the collapsible chamber means when the valve is in the inoperative "OFF" position.

12. A spraying device having controlled additive fluid feed, which comprises:

conduit means for conveying fluid between an entrance orifice and a discharge orifice of the device;

connecting means adjacent the entrance orifice of the device for connecting the conduit means to a source of a primary fluid;

collapsible chamber means for holding a supply of an additive fluid, the chamber means being in communication with the conduit means and being collapsible in response to external pressure to dispense the additive fluid into the conduit means; and a rotatable control valve disposed in the conduit means for selectively diverting at least a portion of the primary fluid at an upstream portion of the conduit means such that the primary fluid exerts pressure on the chamber means to cause the chamber means to collapse and dispense the additive fluid into a downstream portion of the conduit means;

the rotatable control valve being selectively movable into a first operative position in which the control valve permits only the primary fluid to flow through the conduit means, a second operative position in which the control valve diverts a portion of the primary fluid such that the diverted primary fluid exerts external pressure on the collapsible chamber means to dispense the additive fluid into the primary fluid flowing through the conduit means, and a third operative position in which the control valve directs the primary fluid such that the primary fluid exerts pressure on the collapsible chamber means to dispense additive fluid into the conduit means for discharge through the discharge orifice of the device, while precluding flow of the primary fluid through the conduit means for discharge through the discharge orifice; and the rotatable control valve having a first port which is operative when the valve is in the first operative position, second and third ports which are operative when the valve is in the second operative position, and a fourth port which is operative when the valve is in the third operative position.

13. The spraying device as recited in claim 12, which further comprises:

control means mounted adjacent the collapsible chamber means for varying the amount of the second fluid dispensed from the chamber means into the conduit means.

14. The spraying device as recited in claim 13, in which:

the control means is a rotatably mounted disc member having a plurality of orifices of various sizes formed therethrough.

15. The spraying device as recited in claim 12, which further comprises:

spray selector means movably mounted adjacent the discharge orifice of the device and having a plurality of orifices of different configurations formed therethrough, the spray selector means being movable to position respective ones of the orifices therein in alignment with the discharge orifice of the device to vary the configuration of a fluid stream emanating from the discharge orifice.

16. The spraying device as recited in claim 15, in which:

the spray selector means is a rotatably mounted disc member.

17. A spraying device having controlled additive fluid feed, which comprises:

conduit means for conveying fluid between an entrance orifice and a discharge orifice of the device;

a housing open at a first end, the housing having the device entrance orifice formed in the housing adjacent a second opposite end and also having a portion of the device conduit means formed therein, the portion of the device conduit means formed in the housing including an elongated tubular passageway integrally formed with a wall of the housing and extending from the second end to the first open end of the housing, connecting means on the housing adjacent the entrance orifice in the housing for connecting the portion of the conduit means in the housing to a conduit for introducing a primary fluid into the conduit means;

a resilient bladder having an open end and positioned in the open end of the housing for holding a supply of an additive fluid, the housing having an orifice therein adjacent the second end of the housing and through which the primary fluid can flow to exert external pressure on the bladder;

a cap member mounted on the open end of the housing in covering relationship to the open end of the bladder, the cap member also having a portion of the conduit means formed therein in alignment with the portion of the conduit means in the housing, including the elongated tubular passageway, and having an orifice therein through which the additive fluid can flow from the open end of the bladder into the device conduit means;

first control means mounted in the housing adjacent the entrance orifice in the housing for selectively diverting at least a portion of the primary fluid into the orifice in the housing such that the primary fluid exerts external pressure on the bladder to cause the bladder to collapse and dispense the additive fluid from the open end of the bladder through the orifice in the cap member and into the device conduit means; and second control means mounted on the cap member for varying the amount of the additive fluid dispensed from the open end of the bladder into the device conduit means.

18. The spraying device as recited in claim 17, in which:

the first control means is selectively movable into an inoperative "OFF" position, a first operative position in which the first control means permits only the primary fluid to flow through the device conduit means, a second operative position in which the first control means diverts a portion of the primary fluid through the orifice in the housing to exert external pressure on the bladder, while also permitting the primary fluid to flow through the device conduit means, and a third operative position in which the first control means directs the primary fluid through the orifice in the housing to exert external pressure on the bladder and thereby to dispense the additive fluid into the device conduit means for discharge through the discharge orifice of the device, while precluding the primary fluid from flowing through the device conduit means for discharge through the discharge orifice.

19. The spraying device as recited in claim 18, in which:

the first control means is a rotatable valve having a firt port which is operative when the valve is in the first operative position, second and third ports which are operative when the valve is in the second operative position, a fourth port which is operative when the valve is in the third operative position, and a fifth port for draining the primary fluid from the housing and releasing pressure in the bladder when the valve is in the inoperative "OFF" position.

20. The spraying device as recited in claim 19, in which:

the second control means is a rotatably mounted disc member having a plurality of orifices of various sizes formed therethrough.

21. The spraying device as recited in claim 20, which further comprises:

an elongated tube extending from the cap member in alignment with the portion of the conduit means in the cap member, the elongated tube also defining a portion of the conduit means of the device and having an outer end adjacent the discharge orifice of the device; and spray selector means movably mounted adjacent the discharge orifice of the device and the outer end of the elongated tube, and having a plurality of different configurations formed therethrough, the spray selector means being movable to position respective ones of the orifices therein in alignment with the discharge orifice of the device to vary the configuration of a fluid stream emanating from the discharge orifice.

22. The spraying device as recited in claim 21, in which:

the spray selector means is a rotatably mounted disc member.

23. The spraying device as recited in claim 17, in which:

the first control means is selectively movable into an inoperative "OFF" position, a first operative position in which the first control means permits only the primary fluid to flow through the device conduit means, and a second operative position in which the first control means diverts a portion of the primary fluid through the orifice in the housing to exert external pressure on the bladder.

24. The spraying device as recited in claim 23, in which:

the first control means is a rotatable valve having a first port which is operative when the valve is in the first operative position, and having second and third ports which are operative when the valve is in the second operative position.

25. A hand-held telescoping spray tube assembly, which comprises:

an outer tube having a flow passage therethrough and having inner and outer ends;

at least one additional inner tube having a flow passage therethrough and having inner and outer ends, the inner tube being reciprocably mounted in the outer tube and being extendable outwardly relative to the outer tube;

surface means on the inner end of the inner tube responsive to pressure caused by fluid flowing through the tube assembly, to cause the inner tube to move in the outer tube outwardly relative to the outer tube;

movement limiting means on the outer end of the outer tube cooperable with the surface means on the inner end of the inner tube for limiting outward movement of the inner tube in the outer tube; and an annular seal of circular cross section surrounding the inner tube and disposed between opposed surfaces of the inner tube and the outer tube so that the seal rolls on the opposed surfaces of the outer tube and the inner tube as the inner tube reciprocates in the outer tube, with the seal being rollable into an intermediate position between the surface means on the inner tube and the movement limiting means on the outer end of the outer tube when the inner tube is retracted, and rollable against the movement limiting means when the inner tube is extended, said seal providing continuous fluid-tight sealing engagement between the inner tube and the outer tube throughout the reciprocating movement of the inner tube between its extended and retracted positions in the outer tube.

26. The telescoping spray tube assembly as recited in claim 25, in which:

the surface means on the inner end of the inner tube is defined by an annular flange.

27. The telescoping spray tube assembly as recited in claim 26, which further comprises:

a discharge nozzle of a preselected configuration removably mounted on the outer end of the inner tube by a quick-releaseable connection including projecting lugs on an outer end of the inner tube received in respective right-angle slots in the discharge nozzle.

28. The telescoping spray tube assembly as recited in claim 25, in which:

the inner end of the outer tube includes laterally projecting apertured ears for mounting the telescoping spray tube assembly on an associated device.

29. The spraying device as recited in claim 25, in which:

the intermediate position of the annular seal when the inner tube is retracted, is essentially halfway between the annular flange on the inner tube and the annular flange movement limiting means on the outer tube.

30. A spraying device having controlled additive fluid feed, which comprises:

conduit means for conveying fluid between an entrance orifice and a discharge orifice of the device;

connecting means adjacent the entrance orifice of the device for connecting the conduit means to a source of a primary fluid;

collapsible chamber means for holding a supply of an additive fluid, the chamber means being in communication with the conduit means and being collapsible in response to external pressure to dispense the additive fluid into the conduit means; and a control valve disposed in the conduit means for selectively diverting at least a portion of the primary fluid at an upstream portion of the conduit means such that the primary fluid exerts external pressure on the chamber means to cause the chamber means to collapse and dispense the additive fluid into a downstream portion of the conduit means;

the control valve being movable from an inoperative position in which no fluid flows through the conduit means, into a first operative position in which the control valve permits only the primary fluid to flow through the conduit means, and into a second operative position in which the control valve diverts a portion of the primary fluid such that the diverted primary fluid exerts external pressure on the chamber means to cause the additive fluid in the chamber means to be dispensed into the primary fluid flowing through the conduit means;

telescoping spray tube means forming part of the conduit means and including the discharge orifice of the spraying device, for spraying fluid from the device;

the telescoping spray tube means including means for automatically extending a portion of the spray tube means outwardly in response to pressure produced by fluid flowing through the spray tube means;

the telescoping spray tube means also including an outer tube and at least one additional inner tube reciprocably disposed in the outer tube and extendable outwardly relative to the outer tube;

the automatic extending means including an annular flange on an inner end of the inner tube responsive to fluid pressure to cause the inner tube to move in the outer tube outwardly relative to the outer tube;

the outer tube including movement limiting means at an outer end thereof cooperable with the annular flange to limit outward movement of the flange and the inner tube in the outer tube; and an annular seal of circular cross section surrounding the inner tube and disposed between opposed surfaces of the inner tube and the outer tube so that the seal rolls on the opposed surfaces of the outer tube and the inner tube as the inner tube reciprocates in the outer tube, with the seal being rollable into an intermediate position between the annular flange on the inner tube and the annular flange movement limiting means on the outer end of the outer tube when the inner tube is retracted, and against the annular flange movement limiting means on the outer tube when the inner tube is extended.

31. The spraying device as recited in claim 30, in which:

the intermediate position of the annular seal when the inner tube is retracted, is essentially halfway between the annular flange on the inner tube and the annular flange movement limiting means on the outer tube.

32. A spraying device having controlled additive fluid feed, which comprises:

conduit means for conveying fluid between an entrance orifice and a discharge orifice of the device;

connecting means adjacent the entrance orifice of the device for connecting the conduit means to a source of a primary fluid;

collapsible chamber means for holding a supply of an additive fluid, the chamber means being in communication with the conduit means and being collapsible in response to external pressure to dispense the additive fluid into the conduit means; and a control valve disposed in the conduit means for selectively diverting at least a portion of the primary fluid at an upstream portion of the conduit means such that the primary fluid exerts external pressure on the chamber means to cause the chamber means to collapse and dispense the additive fluid into a downstream portion of the conduit means;

the control valve being movable from an inoperative position in which no fluid flows through the conduit means, into a first operative position in which the control valve permits only the primary fluid to flow through the conduit means, and into a second operative position in which the control valve diverts a portion of the primary fluid such that the diverted primary fluid exerts external pressure on the chamber means to cause the additive fluid in the chamber means to be dispensed into the primary fluid flowing through the conduit means;

a housing open at a first end for receiving the collapsible chamber means, the housing having the device entrance orifice formed therein adjacent a second opposite end thereof and having a portion of the device conduit means formed therein, the portion of the device conduit means formed in the housing including an elongated tubular passageway integrally formed with a wall of the housing and extending from the second end of the housing to the first open end of the housing; and a cap member mounted on the first open end of the housing in covering relationship to the collapsible chamber means and having a portion of the device conduit means formed therein in alignment with the portion of the conduit means formed in the housing, including the elongated tubular passageway, and also having an orifice therein through which the additive fluid can flow from the collapsible chamber means into the device conduit means.

33. The spraying device as recited in claim 32, in which:

the housing also has an orifice therein adjacent the second end of the housing and through which the primary fluid flows to exert external pressure on the collapsible chamber means.

34. The spraying device as recited in claim 33, in which:

the valve is disposed in the conduit means adjacent the second end of the housing.

* * * * *